US009062444B2

(12) United States Patent
Shirakawa et al.

(10) Patent No.: US 9,062,444 B2
(45) Date of Patent: Jun. 23, 2015

(54) FLUSH TOILET

(75) Inventors: Shigehisa Shirakawa, Fukuoka (JP); Mayu Okubo, Fukuoka (JP); Toshifumi Yoneda, Fukuoka (JP)

(73) Assignee: TOTO LTD., Fukuoka (JP)

( * ) Notice: Subject to any disclaimer, the term of this patent is extended or adjusted under 35 U.S.C. 154(b) by 405 days.

(21) Appl. No.: 13/468,446

(22) Filed: May 10, 2012

(65) Prior Publication Data

US 2012/0284910 A1 Nov. 15, 2012

(30) Foreign Application Priority Data

May 11, 2011 (JP) ..... 2011-106254
May 11, 2011 (JP) ..... 2011-106255

(51) Int. Cl.

| | |
|---|---|
| ***E03D 11/00*** | (2006.01) |
| ***E03D 1/38*** | (2006.01) |
| ***E03D 11/08*** | (2006.01) |
| *E03D 1/34* | (2006.01) |

(52) U.S. Cl.
CPC *E03D 1/38* (2013.01); *E03D 11/08* (2013.01); *E03D 1/34* (2013.01); *E03D 2201/30* (2013.01); *E03D 2201/40* (2013.01)

(58) Field of Classification Search
CPC . E03D 2201/30; E03D 2201/40; E03D 11/08; E03D 11/13
USPC ..... 4/419, 420, 345, 353, 421–430, 344, 4/363, 378
See application file for complete search history.

(56) References Cited

U.S. PATENT DOCUMENTS

| | | | | |
|---|---|---|---|---|
| 5,711,039 | A * | 1/1998 | Mizrahi | 4/344 |
| 2009/0205119 | A1* | 8/2009 | Lo et al. | 4/420 |
| 2010/0186158 | A1* | 7/2010 | Morita et al. | 4/420 |
| 2012/0284910 | A1 | 11/2012 | Shirakawa et al. | |

FOREIGN PATENT DOCUMENTS

| | | |
|---|---|---|
| JP | 07-180202 | 7/1995 |
| JP | 07-216967 | 8/1995 |

(Continued)

OTHER PUBLICATIONS

Uniform North American Requirements for Toilet Fixtures Guidelines and Specifications, Version 1.2, Jan. 2, 2007. p. 5.*
Japanese Office Action "Notification of Reasons for Rejection" dated Aug. 30, 2012; Japanese Patent Application No. 2011-106254 with partial translation.

(Continued)

*Primary Examiner* — Huyen Le
*Assistant Examiner* — Nicholas Ros
(74) *Attorney, Agent, or Firm* — Studebaker & Brackett PC

(57) ABSTRACT

A flush toilet having a toilet main unit cleaned by flush water is disclosed. The flush toilet comprises a reservoir tank for storing therein flush water; a bowl portion having a waste-receiving surface and a rim section; a drainage passage for expelling waste therethrough by means of siphon action; a rim water spouting port provided in the rim section at a position corresponding to a lateral region of the bowl portion; a jet water spouting port for spouting flush water toward an inlet of the drainage passage; a rim water guide passage for guiding flush water to the rim water spouting port; a jet water guide passage for guiding flush water to the jet water spouting port; and a flow dividing chamber for dividing and distributing flush water to the rim water guide passage and the jet water guide passage, wherein the flow dividing chamber, the rim water guide passage and the rim water spouting port are formed approximately along the same straight line.

13 Claims, 6 Drawing Sheets

(56) References Cited

FOREIGN PATENT DOCUMENTS

| | | | |
|---|---|---|---|
| JP | 2001-271407 | A | 10/2001 |
| JP | 2003-336307 | A | 11/2003 |
| JP | 2004-238891 | A | 8/2004 |
| JP | 2005-113643 | A | 4/2005 |
| JP | 2009-156026 | A | 7/2009 |
| JP | 2009-243052 | A | 10/2009 |
| JP | 2012-237126 | A | 12/2012 |

OTHER PUBLICATIONS

Japanese Office Action "Notification of Reasons for Rejection" dated Aug. 30, 2012; Japanese Patent Application No. 2011-106255 with partial translation.

An Office Action; "Notice of Reasons for Rejection," issued by the Japanese Patent Office on Feb. 4, 2015, which corresponds to Japanese Patent Application No. 2012-272422 and is related to U.S. Appl. No. 13/468,446; with English language partial translation.

* cited by examiner

FLUSH TOILET

TECHNICAL FIELD

The present invention relates to a flush toilet, and more particularly to a flush toilet designed to form a swirl flow of flush water and expel waste by siphon action.

BACKGROUND ART

Heretofore, there has been known a flush toilet which comprises a reservoir tank, and a toilet main unit having a rim water spouting port formed in a lateral region of a bowl portion thereof and a jet water spouting port opposed to a trap drainage passage, wherein the flush toilet is configured such that flush water discharged from the reservoir tank is divided into two flows through a flush water guide passage to allow the flush water to be supplied to both of the rim water spouting port and the jet water spouting port, as described, for example, in JP2001-271407A.

The flush toilet described in JP2001-271407A is provided with a rim water guide passage for guiding flush water discharged from the reservoir tank, to the rim water spouting port via the flush water guide passage, and a jet water guide passage for guiding flush water discharged from the reservoir tank, to the jet water spouting port via the flush water guide passage. Specifically, the rim water guide passage extends bendingly and forwardly from the flush water guide passage toward the rim water spouting port, whereas the jet water guide passage extends from the flush water guide passage to the jet water spouting port, while wrapping around the trap drainage passage.

SUMMARY OF INVENTION

Technical Problem

In the conventional flush toilet described in JP2001-271407A, the rim water guide passage has a bent region, and the jet water guide passage extends to wrap around the trap drainage passage. Therefore, a pressure loss occurs both in the rim water guide passage and the jet water guide passage. The pressure loss includes both a pressure loss arising from the bent region of the water guide passage, and a pressure loss due to an increase in length of the water guide passage.

If the pressure loss in the rim water guide passage becomes larger as above, a start timing of spouting flush water from the rim water spouting port is delayed, which leads to a problem that a siphon action produced by flush water spouted from the jet water spouting port comes to an end before completion of cleaning of the bowl portion by flush water spouted from the rim water spouting port, and thereby waste is left in the bowl portion without being expelled therefrom.

In a flush toilet having a relatively large flush water amount, for example, of 6.0 liters (L), the above problem does not occur, because a flush water amount to be spouted from a rim water spouting port (rim water spouting amount) is relatively large, and a water spouting time is relatively long. However, in connection of the recent demand for water-saving, the above problem has become prominent. Thus, as a prerequisite for putting a water-saving flush toilet to practical use, it is necessary to solve the problem that the siphon action comes to an end before completion of cleaning of the bowl portion, resulting in causing waste to be left in the bowl portion without being expelled therefrom.

The present invention has been made to solve the above problem, and an object thereof is to provide a flush toilet capable of adequately performing a toilet cleaning operation even in a relatively small flush water amount.

Solution to Problem

In order to achieve the above object, according to a first aspect of the present invention, there is provided a flush toilet having a toilet main unit cleaned by flush water. The flush toilet comprises: a reservoir tank for storing therein flush water to be supplied to the toilet main unit, wherein the reservoir tank has a discharge port for discharging flush water therethrough; a bowl portion having a bowl-shaped waste-receiving surface and a rim section located in an upper peripheral region thereof; a drainage passage having an inlet connected to a lower region of the bowl portion to expel waste therethrough by means of siphon action; a rim water spouting portion provided in the rim section at a position corresponding to a lateral region of the bowl portion, to spout flush water in such a manner as to cause the flush water to swirl along the rim section so as to clean the bowl portion; a jet water spouting portion for spouting flush water toward the inlet of the drainage passage; a rim water guide passage for guiding flush water to the rim water spouting portion; a jet water guide passage for guiding flush water to the jet water spouting portion; and a flow dividing chamber for receiving flush water flown from the discharge port of the reservoir tank, and dividing and distributing the flush water to the rim water guide passage and the jet water guide passage, wherein the flow dividing chamber, the rim water guide passage and the rim water spouting portion are formed approximately along the same straight line. According to the present invention configured as above, the flow dividing chamber, the rim water guide passage and the rim water spouting portion are formed approximately along the same straight line, so that it becomes possible to reduce a length of the rim water guide passage and minimize a bent region of the rim water guide passage, thereby reducing a pressure loss which occurs in the rim water guide passage. Thus, the present invention makes it possible to set a start timing of spouting flush water from the rim water spouting portion, to an earlier point, to allow cleaning of the bowl portion to be completed at a timing of or before termination of the siphon action, and thereby adequately perform a toilet cleaning operation even in a relatively small flush water amount.

Preferably, in the flush toilet of the present invention, the jet water guide passage is formed approximately on the same straight line, in plan view, with respect to the rim water guide passage and the flow dividing chamber. According to the present invention configured as above, the jet water guide passage is formed approximately on the same straight line, in plan view, with respect to the rim water guide passage and the flow dividing chamber, so that a start timing of spouting flush water from the rim water spouting portion and a start timing of spouting flush water from the jet water spouting portion can be set to approximately the same point, to allow cleaning of the bowl portion to be completed at a timing of or before termination of the siphon action. This makes it possible to adequately perform the toilet cleaning operation even in a relatively small flush water amount, while preventing waste from being left in the bowl portion.

Preferably, in the flush toilet of the present invention, the rim water spouting portion has a single rim water spouting port. According to the present invention configured as above, the number of rim water spouting ports is one, so that, as compared to the case where the number of rim water spouting ports is two or more, the start timing of spouting flush water from the rim water spouting portion can be set to an earlier point to allow cleaning of the bowl portion to be completed at a timing of or before termination of the siphon action. This makes it possible to adequately perform the toilet cleaning operation even in a relatively small flush water amount.

Preferably, in the flush toilet of the present invention, the rim water spouting portion is disposed on a lower side of the rim section. According to the present invention configured as above, the rim water spouting portion is disposed on a lower side of the rim section, so that it becomes possible to prevent flush water from jumping out beyond the rim section even if the energy or force of flush water spouted from the rim water spouting portion is increased.

Preferably, in the flush toilet of the present invention, the toilet main unit is cleaned by 3.6 to 4.2 liters of flush water.

Preferably, in the flush toilet of the present invention, the reservoir tank is provided in such a manner that a bottom surface thereof is located spaced apart upwardly from a top surface of the toilet main unit by a predetermined distance. According to the present invention configured as above, the reservoir tank is provided in such a manner that a bottom surface thereof is located spaced apart upwardly from a top surface of the toilet main unit by a predetermined distance, so that it becomes possible to, even in a situation where a flush water amount in the reservoir tank is reduced due to the demand for water-saving, apply a sufficient hydraulic head pressure to the flush water to adequately supply the flush water to the toilet main unit. This makes it possible to ensure cleaning performance even in the situation where the flush water amount is reduced due to the demand for water-saving.

Preferably, the above flush toilet further comprises a flush-water stagnating portion provided between the discharge port of the reservoir tank and the flow dividing chamber for temporarily stagnating flush water. According to the present invention configured as above, a flush-water stagnating portion is provided between the discharge port of the reservoir tank and the flow dividing chamber for temporarily stagnating flush water, so that a hydraulic head pressure is applied to the stagnated flush water, and thereby the flush water can be forcefully supplied to the rim water spouting portion and the jet water spouting portion from the flow dividing chamber via respective ones of the rim water guide passage and the jet water guide passage. This makes it possible to ensure cleaning performance even in a situation where the flush water amount is reduced due to the demand for water-saving.

Preferably, in the above flush toilet, the flush-water stagnating portion is composed of a cylinder member disposed between the discharge port of the reservoir tank and the top surface of the toilet main unit, and an area of an inlet of the jet water guide passage is smaller than a cross-sectional area of the cylinder member. According to the present invention configured as above, an area of an inlet of the jet water guide passage is smaller than a cross-sectional area of the cylinder member disposed between the discharge port of the reservoir tank and the top surface of the toilet main unit, so that the inlet of the jet water guide passage poses a flow resistance to flush water when it flows into the jet water guide passage from the cylinder member via the flow dividing chamber. Thus, flush water becomes more likely to be temporarily stagnated in the cylinder member and more effectively supplied with a hydraulic head pressure, which allows the flush water to be forcefully supplied to the rim water spouting portion and the jet water spouting portion from the flow dividing chamber via respective ones of the rim water guide passage and the jet water guide passage. This makes it possible to ensure cleaning performance even in the situation where the flush water amount is reduced due to the demand for water-saving.

Preferably, in the above flush toilet, the discharge port of the reservoir tank is provided approximately directly above an inlet of the jet water guide passage. According to the present invention configured as above, the discharge port of the reservoir tank is provided approximately directly above an inlet of the jet water guide passage, so that flush water can be forcefully supplied to the jet water spouting portion from the flow dividing chamber via the jet water guide passage. This makes it possible to produce a stronger siphon action to provide enhanced cleaning performance. In addition, air bubbles remaining in the jet water guide passage can be effectively released toward the reservoir tank.

Preferably, in the above flush toilet, the jet water guide passage is configured to, in a last half of a toilet cleaning operation, allow flush water stagnated in the flush-water stagnating portion to flow into the jet water guide passage in an amount greater than that flowing into the rim water guide passage. According to the present invention configured as above, the jet water guide passage is configured to, in a last half of a toilet cleaning operation, allow flush water stagnated in the flush-water stagnating portion to flow into the jet water guide passage in an amount greater than that flowing into the rim water guide passage, so that it becomes possible to produce the siphon action more strongly and for a longer period of time, to provide enhanced cleaning performance.

Preferably, in the above flush toilet, the jet water guide passage is configured such that an upstream region thereof inclines downwardly with respect to a horizontal line by 55 to 65 degrees. According to the present invention configured as above, air bubbles remaining in the jet water guide passage can be effectively released toward the reservoir tank.

According to a second aspect of the present invention, there is provided a flush toilet having a toilet main unit cleaned by flush water. The flush toilet comprises: a reservoir tank for storing therein flush water to be supplied to the toilet main unit, wherein the reservoir tank has a discharge port for discharging flush water therethrough; a bowl portion having a bowl-shaped waste-receiving surface and a rim section located in an upper peripheral region thereof; a drainage passage having an inlet connected to a lower region of the bowl portion to expel waste therethrough by means of siphon action; a rim water spouting portion provided in the rim section at a position corresponding to a lateral region of the bowl portion, to spout flush water in such a manner as to cause the flush water to swirl along the rim section so as to clean the bowl portion; a jet water spouting portion for spouting flush water toward the inlet of the drainage passage; a rim water guide passage for guiding flush water to the rim water spouting portion; a jet water guide passage for guiding flush water to the jet water spouting portion; and a flow dividing chamber for receiving flush water flown from the discharge port of the reservoir tank, and dividing and distributing the flush water to the rim water guide passage and the jet water guide passage, wherein the reservoir tank is provided in such a manner that a bottom surface thereof is located spaced apart upwardly from a top surface of the toilet main unit by a predetermined distance. According to the present invention configured as above, the reservoir tank is provided in such a manner that a bottom surface thereof is located spaced apart upwardly from a top surface of the toilet main unit by a predetermined distance, so that it becomes possible to, even in a situation where a flush water amount in the reservoir tank is reduced due to the demand for water-saving, apply a sufficient hydraulic head pressure to the flush water to adequately supply the flush water to the toilet main unit. This makes it possible to ensure cleaning performance even in the situation where the flush water amount is reduced due to the demand for water-saving.

According to a third aspect of the present invention, there is provided a flush toilet having a toilet main unit cleaned by flush water. The flush toilet comprises: a reservoir tank for storing therein flush water to be supplied to the toilet main unit, wherein the reservoir tank has a discharge port for discharging flush water therethrough; a bowl portion having a bowl-shaped waste-receiving surface and a rim section located in an upper peripheral region thereof; a drainage passage having an inlet connected to a lower region of the bowl portion to expel waste therethrough by means of siphon action; a rim water spouting portion provided in the rim section at a position corresponding to a lateral region of the bowl portion, to spout flush water in such a manner as to cause the flush water to swirl along the rim section so as to clean the bowl portion; and a rim water guide passage for receiving an inflow of flush water from the discharge port of the reservoir tank and guiding the flush water to the rim water spouting portion, wherein: the rim water guide passage and the rim water spouting portion are formed approximately along the same straight line; and the flush toilet is configured to clean the toilet main unit using 3.6 to 4.2 liters of flush water. According to the present invention configured as above, the rim water guide passage and the rim water spouting portion are formed approximately along the same straight line, so that it becomes possible to reduce a length of the rim water guide passage and minimize a bent region of the rim water guide passage, thereby reducing a pressure loss which occurs in the rim water guide passage. Thus, the present invention makes it possible to adequately perform the toilet cleaning operation even in a relatively small flush water amount.

Advantageous Effects of the Invention

The flush toilet of the present invention is capable of adequately performing a toilet cleaning operation even in a relatively small flush water amount.

DESCRIPTION OF EMBODIMENTS

Figure 1:
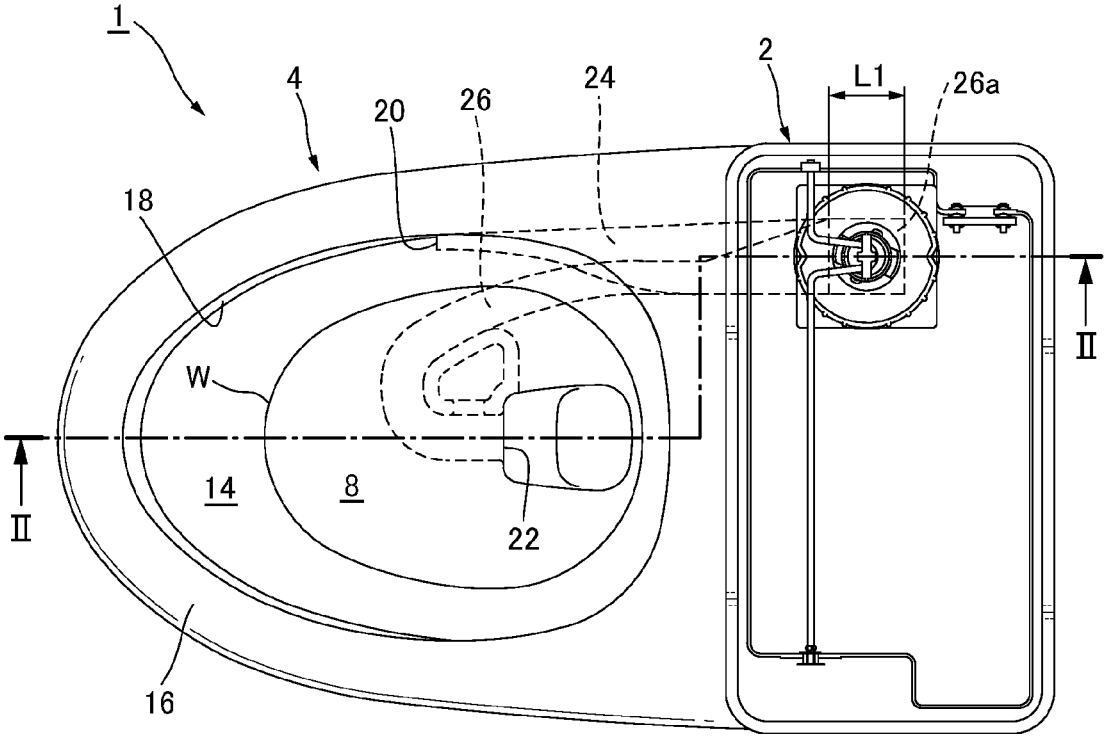
FIG. 1 is a top plan view illustrating a flush toilet according to one embodiment of the present invention.

With reference to the drawings, a flush toilet of the present invention will now be described based on an embodiment thereof. First, a fundamental structure of the flush toilet according to the embodiment will be described with reference to FIGS. 1 and 2. FIG. 1 is a top plan view illustrating the flush toilet according to the embodiment, and FIG. 2 is a side sectional view taken along the line II-II in FIG. 1.

Figure 2:
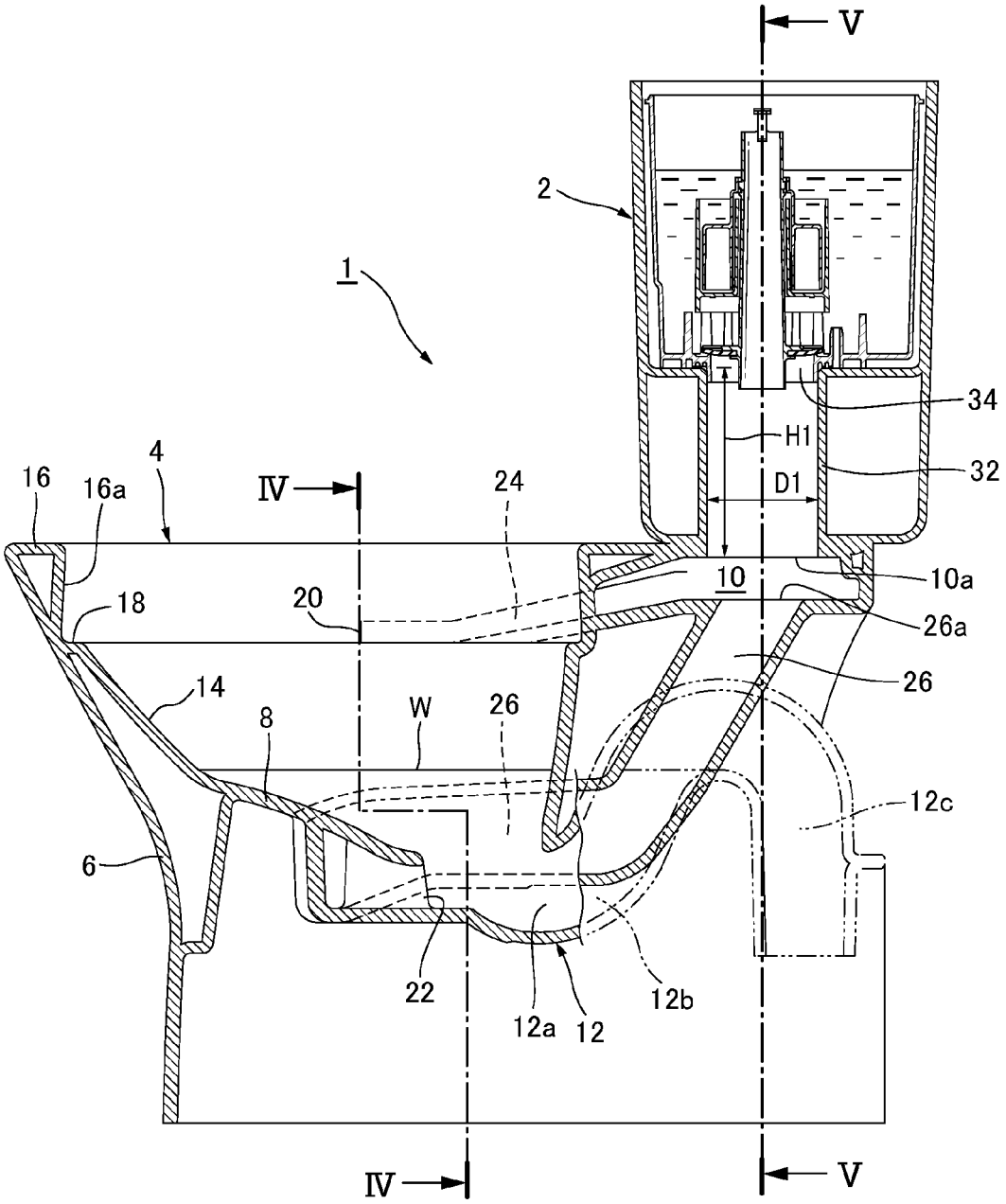
FIG. 2 is a side sectional view taken along the line II-II in FIG. 1.

As illustrated in FIGS. 1 and 2, the flush toilet 1 according to the embodiment is a tank-type water-saving flush toilet, which comprises a reservoir tank 2 for storing flush water therein, and a toilet main unit 4 adapted to be supplied with flush water. The reservoir tank 2 is attached to the toilet main unit 4.

The toilet main unit 4 is a porcelain product having a glaze layer formed on a surface thereof, wherein a lower portion thereof is formed as a skirt portion 6, and an upper half thereof comprises a front portion formed as a bowl portion 8, a upper rear portion formed as a flow dividing chamber 10, and a lower rear portion formed as a drainage passage 12.

The bowl portion 8 has a bowl-shaped waste-receiving surface 14, and a rim section 16 which forms an upper peripheral region thereof. The rim section 16 has a shelf surface 18 formed on a lower side thereof and along the entire periphery of an upper edge of the bowl portion 8. The rim section 16 also has an inward-facing surface 16*a* formed to extend approximately vertically so as to eliminate blind spots when viewed from thereabove. This makes it possible to readily wipe the inward-facing surface 16*a* using a disposable paper or the like during cleaning, while preventing flush water from jumping out.

An inlet 12*a* of the drainage passage 12 is opened in the center of the waste-receiving surface 14 and below a pooled-water level (water-sealing water level) W. The drainage passage 12 has a rising passage 12*b* extending from the inlet 12*a* rearwardly, and a falling passage (vertical pipe) 12*c* continuous with the rising passage 12*b*. The falling passage 12*c* has a lower end connected to a drain pipe (not illustrated) via a drain socket (not illustrated).

When viewing the toilet main unit 4 rearwardly from a front side thereof, a rim water spouting port 20 is formed in a left lateral region of the shelf surface 18 of the rim section 16, and a jet water spouting port 22 is formed in a lower region of the bowl portion 8 in opposed relation to the inlet 12*a* of the drainage passage 12. In the embodiment, the number of the rim water spouting ports 20 is preferably set to one or single. The rim water spouting port 20 is configured to spout flush water therefrom onto the shelf surface 18, in such a manner as to cause the flush water to flow toward the bowl portion 8 while swirling along the shelf surface, thereby cleaning the bowl portion 8. The jet water spouting port 22 is configured to spout flush water therefrom toward the inlet 12*a* of the drainage passage 12, thereby producing a siphon action. The flush water spouted from the jet water spouting port 22 also serves as refilling water (water-sealing water).

The toilet main unit 4 is internally formed with a rim water guide passage 24 for supplying flush water to the rim water spouting port 20, and a jet water guide passage 26 for supplying flush water to the jet water spouting port 22. Respective detailed structures of the rim water guide passage 24 and the jet water guide passage 26 will be described later.

The flow dividing chamber 10 is formed with a flush water inlet 10*a* on an upper side thereof, so that flush water in the reservoir tank 2 can flow into the flow dividing chamber 10 through the flush water inlet 10*a*. Further, the flow dividing chamber 10 is connected to each of the rim water guide passage 24 and the jet water guide passage 26, and configured to divide the flush water into two flows to be supplied to respective ones of the rim water spouting port 20 and the jet water spouting port 22.

Figure 3:
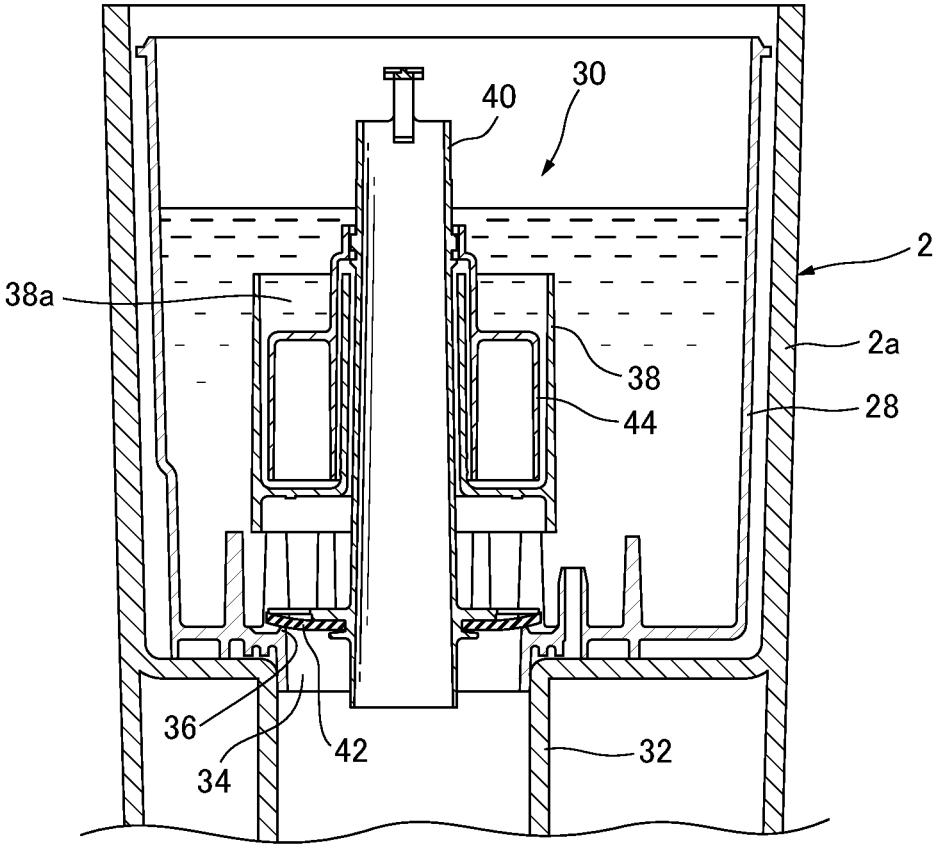
FIG. 3 is an enlarged side sectional view illustrating a discharge valve usable in a flush toilet according to one embodiment of the present invention.

With reference to FIG. 3, a structure of the reservoir tank will be described below. FIG. 3 is an enlarged side sectional view illustrating a discharge valve usable in a flush toilet according to one embodiment of the present invention. As illustrated in FIG. 3, the reservoir tank 2 comprises an outer tank 2*a*, an inner tank 28 disposed inside the outer tank 2*a*, and a discharge valve 30 installed inside the inner tank 28. Further, a cylinder member 32 is provided on a downstream side of the discharge valve 30 in order to obtain a required hydraulic head pressure and temporarily stagnate flush water. The cylinder member 32 functions as a flush-water stagnating portion. A detailed structure thereof will be described below. The cylinder member 32 may be integrally formed with the outer tank 2*a*, or may be formed as a separate member with respect to the outer tank 2*a*.

The inner tank 28 has a discharge port 34 formed in a bottom thereof, and a valve seat 36 formed along an upper peripheral edge of the discharge port 34. A control cylinder 38 is disposed directly above the discharge port 34, while being fixed to the bottom of the inner tank 28. An overflow tube 40 is inserted in an internal space of the control cylinder 38. A circular disc-shaped valve element 42 is attached to a lower end of the overflow tube 40, and a float 44 is attached to an intermediate portion of the overflow tube 40. The float 44 is disposed in a reservoir chamber 38*a* formed inside the control cylinder 38, in a floatable manner. As described above, the overflow tube 40, the valve element 42 and the float 44 are formed as an integral assembly, and adapted to be movable in an up-down direction. The reservoir chamber 38*a* of the control cylinder 38 has a bottom formed with a control orifice (not illustrated), so that flush water in the reservoir chamber 38*a* can flow out of the reservoir chamber 38*a* through the control orifice.

An operation of the discharge valve 30 will be described below. When a non-illustrated manual operation lever is operated, the overflow tube 40 is moved upwardly together with the valve element 42 and the float 44, according to a drive mechanism, so that the valve element 42 becomes spaced apart from the valve seat 36 to allow flush water to flow out through the discharge port 34. In this state, flush water in the reservoir chamber 38*a* flows out little-by-little through the control orifice, so that a level of flush water in the reservoir chamber 38*a* will be gradually lowered. Thus, along with lowering of the water level, the float 44 will be gradually moved downwardly. This makes it possible to prevent the discharge port 34 from being prematurely closed due to an excessively rapid downward movement of the valve element 42.

Figure 4:
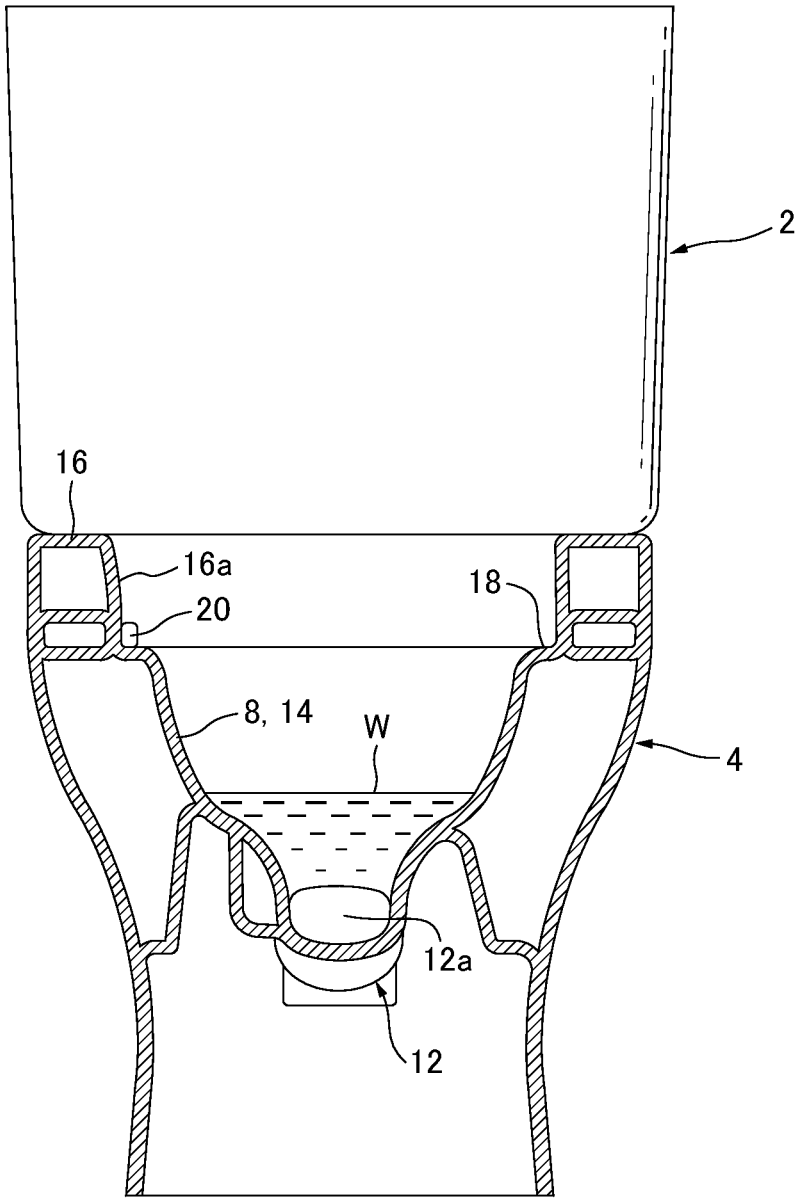
FIG. 4 is a front sectional view taken along the line IV-IV in FIG. 2.
Figure 5:
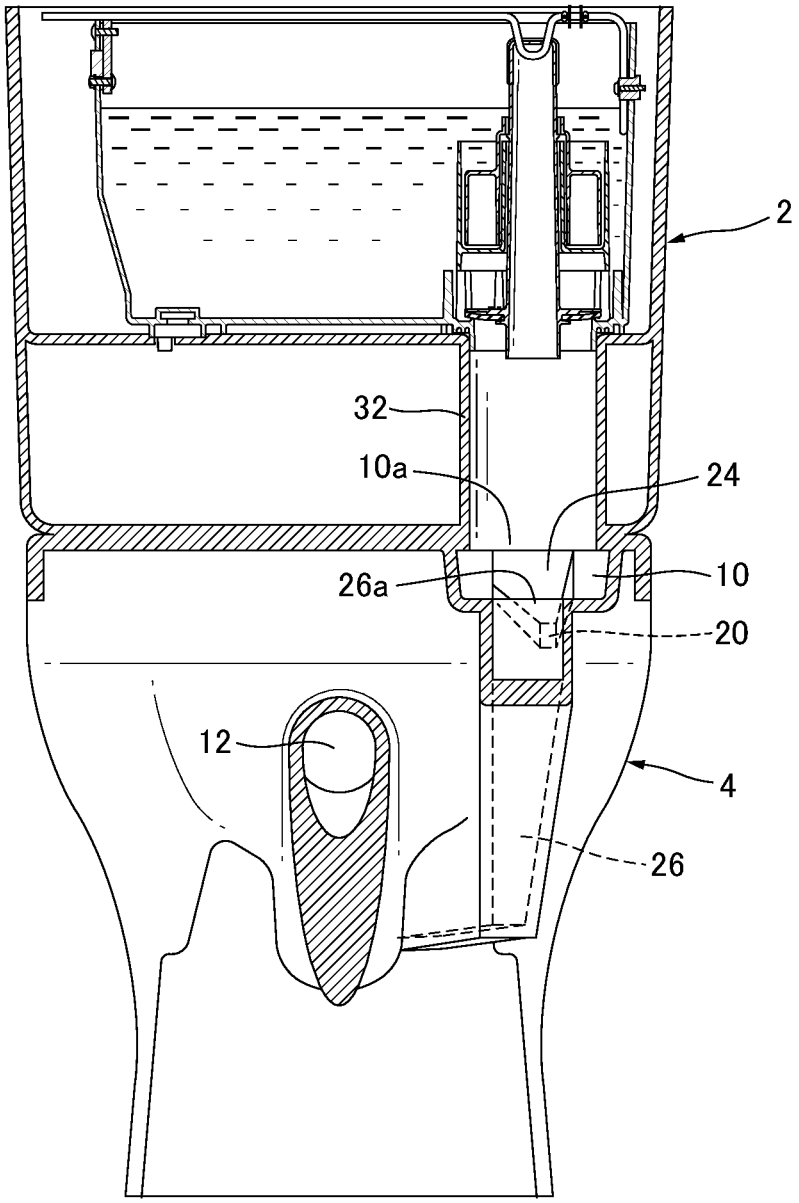
FIG. 5 is a back sectional view taken along the line V-V in FIG. 2.

With reference to FIGS. 1, 2, 4 and 5, each of the cylinder member 32, the rim water guide passage 24 and the jet water guide passage 26 will be described in detail below. FIG. 4 is a front sectional view taken along the line IV-IV in FIG. 2, and FIG. 5 is a back sectional view taken along the line V-V in FIG. 2. As illustrated in FIG. 2, the cylinder member 32 has a predetermined height dimension H1 and a predetermined diameter dimension D1. Thus, a height position itself of the inner tank 28 storing therein flush water, as measured from a top surface of the toilet main unit 4, becomes higher by the height dimension H1, and a hydraulic head pressure of the flush water is increased accordingly. Additionally, when flush water is temporarily stagnated in the cylinder member 32 (details of the reason will be described later), a hydraulic pressure is also applied to the stagnated flush water. The flush water inlet 10*a* of the flow dividing chamber 10 is formed to have a dimension equal to the diameter D1 of the cylinder member 32.

As illustrated in the top plan view of FIG. 1, the discharge port 34 of the reservoir tank 2 is formed at a position offset on a left side as viewed rearwardly from a front side of the reservoir tank 2. As illustrated in FIGS. 1 and 2, the cylinder member 32 is attached directly below the discharge port 34, and the flow dividing chamber 10 in the toilet main unit 4 is formed directly below the cylinder member 32.

As illustrated in FIGS. 1 and 2, the rim water guide passage 24 has an upstream end connected to the flow dividing chamber 10, and a downstream end connected to the rim water spouting port 20. The rim water guide passage 24 is formed to have an approximately linear or straight shape. Thus, the flow dividing chamber 10, the rim water guide passage 24 and the rim water spouting port 20 are formed approximately along the same straight line extending in a horizontal direction, as is clear from FIGS. 1 and 2. As above, the rim water guide passage 24 is formed to be substantially free of a bent region.

The jet water guide passage 26 has an inlet 26*a* connected to the flow dividing chamber 10, and a downstream end connected to the jet water spouting port 22. The inlet 26*a* of the jet water guide passage 26 is formed in a square shape having a length L1 on a side (see FIG. 1), and an area of the inlet 26*a* of the jet water guide passage 26 is set to be less than a cross-sectional area of the cylinder member 32. Further, the inlet 26*a* of the jet water guide passage 26 is formed directly below the discharge port 34 of the reservoir tank 2, the cylinder member 32 and the flow dividing chamber 10.

As illustrated in FIG. 2, the jet water guide passage 26 is formed such that an upstream region thereof inclines downwardly with respect to a horizontal line by 60 degrees. Preferably, the upstream region of the jet water guide passage 26 inclines downwardly with respect to a horizontal line by an inclination angle ranging from 55 to 65 degrees. Further, as illustrated in FIG. 1, with respect to the rim water guide passage 24 and the flow dividing chamber 10, the jet water guide passage 26 is formed approximately on a same straight line, in plan view.

Here, a flush water amount to be used by the flush toilet 1 will be described. In a state before start of cleaning (flushing), the reservoir tank 2 stores therein flush water supplied from an external feed-water pipe (not illustrated). A flush water amount storable in the reservoir tank 2 (flush water storage capacity of the reservoir tank 2) is 2.5 liters (L). Preferably, the flush water storage capacity of the reservoir tank 2 is set in the range of 2.3 to 2.9 L. Additionally, after termination of a siphon action, flush water supplied from an external water-feed pipe is refilled in the toilet main unit 4 via the reservoir tank 2. An amount of the refilling of flush water (refilling amount) is 1.3 L. As above, a flush water amount (total water spouting amount) required for cleaning the toilet main unit of the flush toilet according to the embodiment is 3.8 L (or, preferably, in the range of 3.6 to 4.2 L), including the refilling amount. In this connection, the flush toilet according to the embodiment may be configured to store therein flush water in the required flush water amount (total water spouting amount) including the refilling amount. In this case, 3.8 L (or, preferably, 3.6 to 4.2 L) of flush water is stored in the reservoir tank.

Figure 6:
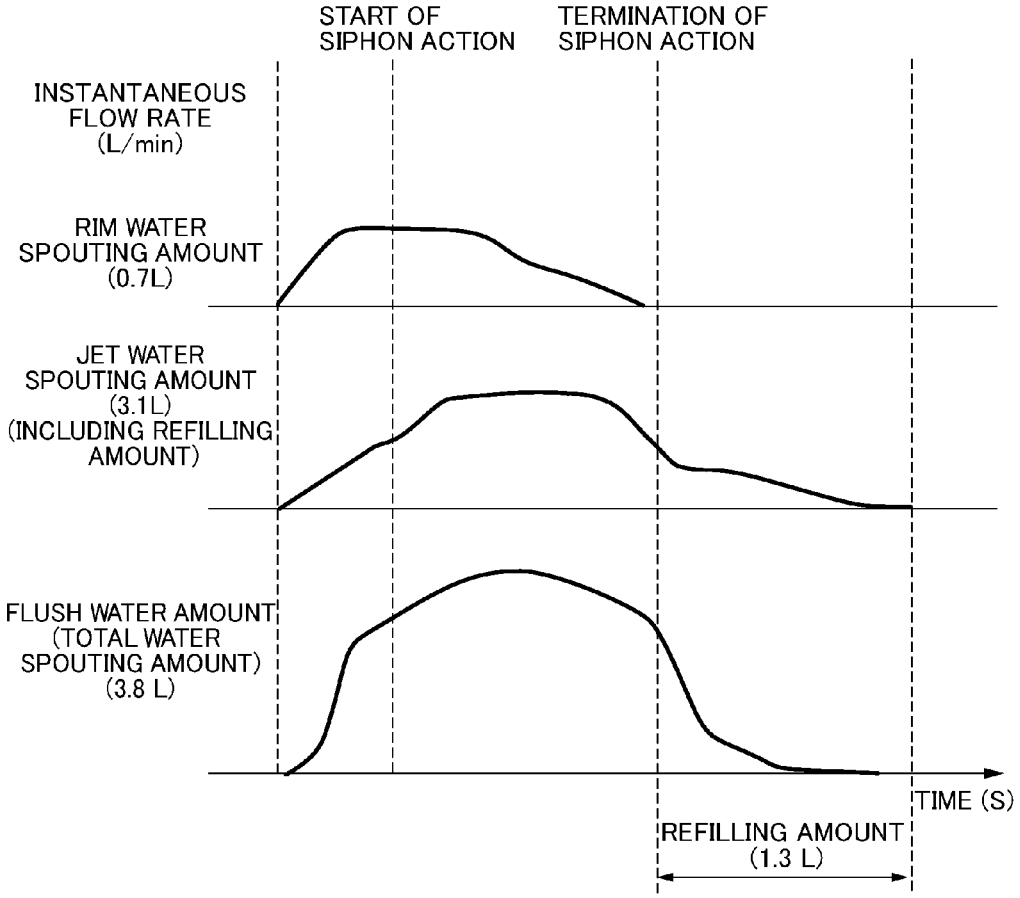
FIG. 6 is a diagram illustrating an instantaneous flow rate of flush water spouted from each of a rim water spouting port and a jet water spouting port in a flush toilet according to one embodiment of the present invention.

An operation of the flush toilet according to the embodiment will be described below. With reference to FIG. 6, a relationship between an instantaneous flow rate of flush water spouted from each of the rim water spouting port and the jet water spouting port, and an elapsed time, will first be described below. As illustrated in FIG. 6, in the embodiment, 2.5 L of flush water is stored in the reservoir tank 2. In the 2.5 L flush water, an amount of flush water required for cleaning the bowl portion 8 (which is spouted from the rim water spouting port 20) is 0.7 L, and an amount of flush water required for producing a siphon action is 1.8 L. Additionally, after termination of the siphon action, 1.3 L of flush water required for refilling is supplied from a water-feed pipe (not illustrated) and spouted from the jet water spouting port 22 via the reservoir tank 2, as mentioned above.

Specifically, when a user operates the manual operation lever of the reservoir tank 2, the valve element 42 of the discharge valve 30 is moved upwardly together with the overflow tube 40 and the float 44, i.e., moved away from the valve seat 36, so that the discharge valve 30 is placed in an open state. Then, flush water falls through the cylinder member 32 and flows into the flow dividing chamber 10. In the flow dividing chamber 10, the flush water is divided and distributed to the rim water guide passage 24 and the jet water guide passage 26, so that a part of the flush water is spouted from the rim water spouting port 20 via the rim water guide passage 24, and the remaining flush water is spouted from the jet water spouting port 22 via the jet water guide passage 26.

In this process, as illustrated in FIG. 6, respective spouting start timings in the rim water spouting port 20 and the jet water spouting port 22 are approximately coincident with each other. The flush toilet according to the embodiment is configured such that the spouting from the rim water spouting port 20 is completed at a timing of or before termination of the siphon action.

The operation of the flush toilet according to the embodiment will now be more specifically described below. When the discharge valve 30 is opened, flush water stored in the inner tank 28 is discharged from the discharge port 34. The discharged flush water falls through the cylinder member 32 and flows into the flow dividing chamber 10 of the toilet main unit 4 located directly below the cylinder member 32. In the embodiment, the bottom of the reservoir tank 2 (inner tank 28) is provided spaced apart upwardly from the top surface of the toilet main unit 4 by a distance corresponding to the height dimension H1 of the cylinder member 32. Thus, even in a situation where the flush water amount in the reservoir tank 2 is reduced due to the demand for water-saving, a sufficient hydraulic head pressure is applied to flush water in the above process to allow the flush water to be adequately supplied to the toilet main unit 4. Therefore, the flush toilet 1 according to the embodiment can ensure cleaning performance even in the situation where the flush water amount is reduced due to the demand for water-saving.

In the embodiment, the cylinder member 32 is provided to allow flush water in the reservoir tank 2 to flow toward the flow dividing chamber 10 of the toilet main unit 4, wherein the discharge port 34 and the cylinder member 32 are disposed directly above the inlet 26*a* of the jet water guide passage 26, and the area of the inlet 26*a* of the jet water guide passage 26 is set to be less than the cross-sectional area of the cylinder member 32. Thus, when flush water flows toward the flow dividing chamber 10, the flush water is temporarily stagnated in the cylinder member 32.

In this manner, flush water is temporarily stagnated in the cylinder member 32 provided between the discharge port of the reservoir tank 2 and the flow dividing chamber 10, i.e., the cylinder member 32 functions as a flush-water stagnating portion, so that a hydraulic head pressure is additionally applied to the flush water during the stagnation, and thereby the flush water is forcefully supplied to the rim water spouting port 20 and the jet water spouting port 22 via respective ones of the rim water guide passage 24 and the jet water guide passage 26. Therefore, the flush toilet 1 according to the embodiment can ensure cleaning performance even in the situation where the flush water amount is reduced due to the demand for water-saving.

In the embodiment, the area of the inlet 26*a* of the jet water guide passage 26 is set to be less than the cross-sectional area of the cylinder member 32, so that the inlet 26*a* of the jet water guide passage 26 poses a flow resistance to flush water when it flows into the jet water guide passage 26 from the cylinder member 32 via the flow dividing chamber 10. Thus, flush water becomes more likely to be temporarily stagnated in the cylinder member 32 and more effectively supplied with a hydraulic head pressure, which allows the flush water to be forcefully supplied to the rim water spouting port 20 and the jet water spouting port 22 from the flow dividing chamber 10 via respective ones of the rim water guide passage 24 and the jet water guide passage 26.

In the embodiment, the discharge port 34 of the reservoir tank 2 is provided approximately directly above the inlet 26*a* of the jet water guide passage 26, so that flush water can be forcefully supplied to the jet water spouting port 22 from the flow dividing chamber 10 via the jet water guide passage 26. This makes it possible to produce a stronger siphon action to provide enhanced cleaning performance. In addition, air bubbles remaining in the jet water guide passage 26 can be effectively released into the cylinder member 32, i.e., toward the reservoir tank, so that it becomes possible to provide more enhanced cleaning performance.

In the embodiment, the inlet 26*a* of the jet water guide passage 26 is opened directly below the cylinder member 32, so that, in a last half of a toilet cleaning operation, flush water stagnated in the cylinder member 32 flows into the jet water guide passage 26 in an amount greater than that flowing into the rim water guide passage 24. Thus, in the last half of the toilet cleaning operation where a siphon action becomes weak, a hydraulic head pressure can be applied to flush water to be spouted via the jet water guide passage 26 to produce a siphon action more strongly and for a longer period of time and thereby provide enhanced cleaning performance.

In the embodiment, the upstream region of the jet water guide passage 26 is formed to incline downwardly with respect to a horizontal line by 55 to 65 degrees, preferably, 60 degrees. Thus, air bubbles remaining in the jet water guide passage 26 can be effectively released into the cylinder member 32, i.e., toward the reservoir tank, so that it becomes possible to provide more enhanced cleaning performance.

Further, in the flush toilet according to the embodiment, the flow dividing chamber 10, the rim water guide passage 24 and the rim water spouting port 20 are formed approximately along the same straight line extending in a horizontal direction, so that it becomes possible to reduce a length of the rim water guide passage 24 and minimize a bent region of the rim water guide passage 24, thereby reducing a pressure loss which occurs in the rim water guide passage 24. This makes it possible to set a start timing of spouting flush water from the rim water spouting port 20, to an earlier point (see FIG. 6), to allow cleaning of the bowl portion to be completed at a timing of or before termination of a siphon action produced by flush water spouted from the jet water spouting port 22, and thereby adequately perform a toilet cleaning operation even in a relatively small flush water amount.

In the embodiment, with respect to the rim water guide passage 24 and the flow dividing chamber 10, the jet water guide passage 26 is formed approximately on the same straight line, in plan view (see FIG. 1), so that a start timing of spouting flush water from the rim water spouting port 20 and a start timing of spouting flush water from the jet water spouting port 22 can be set to approximately the same point (see FIG. 6), to allow cleaning of the bowl portion 8 to be completed at a timing of or before termination of the siphon action. This makes it possible to adequately perform the toilet cleaning operation even in a relatively small flush water amount, while preventing waste from being left in the bowl portion 8.

In the embodiment, the number of the rim water spouting ports 20 is set to one. In this case, as compared to the case where the number of the rim water spouting ports is two or more, the start timing of spouting flush water from the rim water spouting port 20 can be set to an earlier point to allow cleaning of the bowl portion to be completed at a timing of or before termination of the siphon action. This makes it possible to adequately perform the toilet cleaning operation even in a relatively small flush water amount.

In the embodiment, the rim water spouting port 20 is provided in the shelf surface 18 located on the lower side of the rim section, so that it becomes possible to prevent flush water from jumping out beyond the rim section 16 even if the energy or force of flush water spouted from the rim water spouting port 20 is increased.

The flush toilet according to the embodiment is applicable to a water-saving flush toilet. In this case, a flush water amount for use in cleaning the toilet main unit is preferably set in the range of 3.6 to 4.2 L.

In addition to the above embodiment, the present invention is applicable to a flush toilet of a type designed to spout flush water only from a rim water spouting port. This type of flush toilet may have the same fundamental structure as that of the flush toilet according to the above embodiment. On the other hand, differently from the structure of the flush toilet according to the above embodiment, the flow dividing chamber, the jet water spouting port and the jet water guide passage are not formed in the toilet main unit. Thus, flush water in a reservoir tank flows out from a discharge port of the reservoir tank and flows directly into an upstream end of a rim water guide passage via a cylinder member. This rim water guide passage is substantially the same as the rim water guide passage 24 in the above embodiment, and the rim water guide passage and the rim water spouting port are formed approximately along the same straight line.

Although the present invention has been explained with reference to specific, preferred embodiments, one of ordinary skill in the art will recognize that modifications and improvements can be made while remaining within the scope and spirit of the present invention. The scope of the present invention is determined solely by appended claims.

What is claimed is:

1. A flush toilet having a toilet main unit cleaned by flush water, comprising:

a reservoir tank for storing therein flush water to be supplied to the toilet main unit, the reservoir tank having a discharge port for discharging flush water therethrough;

a bowl portion having a bowl-shaped waste-receiving surface and a rim section located in an upper peripheral region thereof, the rim section having an inward-facing surface;

a drainage passage having an inlet connected to a lower region of the bowl portion to expel waste therethrough by means of siphon action;

a rim water spouting portion provided in the rim section at a position corresponding to a lateral region of the bowl portion, to spout flush water frontward in such a manner as to cause the flush water to swirl in one direction along the inward-facing surface of the rim section so as to clean the bowl portion;

a jet water spouting portion for spouting flush water toward the inlet of the drainage passage;

a rim water guide passage for guiding flush water to the rim water spouting portion;

a jet water guide passage for guiding flush water to the jet water spouting portion; and a flow dividing chamber for receiving an inflow of flush water from the discharge port of the reservoir tank, and dividing and distributing the flush water to the rim water guide passage and the jet water guide passage;

wherein the flow diving chamber is formed at a position offset on one side as viewed from a front side; and the flow dividing chamber, the rim water guide passage and the rim water spouting portion are formed approximately along a same straight line.

2. The flush toilet according to claim 1, wherein, an upstream region of the jet water guide passage is formed under the rim water guide passage and the flow diving chamber approximately on a same straight line, in plan view, with respect to the rim water guide passage and the flow dividing chamber.

3. The flush toilet according to claim 1, wherein the rim water spouting portion has a single rim water spouting port.

4. The flush toilet according to claim 1, wherein the rim water spouting portion is disposed on a lower side of the rim section.

5. The flush toilet according to in claim 1, wherein the toilet main unit is cleaned by 3.6 to 4.2 liters of flush water.

6. The flush toilet according to claim 1, wherein the reservoir tank is provided in such a manner that a bottom surface thereof is located spaced apart upwardly from a top surface of the toilet main unit by a predetermined distance.

7. The flush toilet according to claim 6, wherein the flush toilet further comprises a flush-water stagnating portion provided between the discharge port of the reservoir tank and the flow dividing chamber for temporarily stagnating the flush water to apply a hydraulic head pressure to the flush water, wherein the flush water stagnates in the flush-water stagnating portion and the flow dividing chamber; and the stagnated flush water is supplied from the flow dividing chamber to the rim water spouting portion and the jet water spouting portion through the rim water guide passage and the jet water guide passage.

8. The flush toilet according to claim 7, wherein the flush-water stagnating portion is composed of a cylinder member disposed between the discharge port of the reservoir tank and the top surface of the toilet main unit, and an area of an inlet of the jet water guide passage is smaller than a cross-sectional area of the cylinder member.

9. The flush toilet according to claim 7, wherein the discharge port of the reservoir tank is provided approximately directly above an inlet of the jet water guide passage.

10. The flush toilet according to claim 9, wherein the jet water guide passage is configured to, in a last half of a toilet cleaning operation, allow flush water stagnated in the flush-water stagnating portion to flow into the jet water guide passage in an amount greater than that flowing into the rim water guide passage.

11. The flush toilet according to claim 6, wherein the jet water guide passage is configured such that an upstream region thereof inclines downwardly with respect to a horizontal line by 55 to 65 degrees.

12. A flush toilet having a toilet main unit cleaned by flush water, comprising:

a reservoir tank for storing therein flush water to be supplied to the toilet main unit, the reservoir tank having a discharge port for discharging flush water therethrough;

a bowl portion having a bowl-shaped waste-receiving surface and a rim section located in an upper peripheral region thereof, the rim section having an inward-facing surface;

a drainage passage having an inlet connected to a lower region of the bowl portion to expel waste therethrough by means of siphon action;

a rim water spouting portion provided in the rim section at a position corresponding to a lateral region of the bowl portion, to spout flush water in such a manner as to cause the flush water to swirl in one direction along the inward-facing surface of the rim section so as to clean the bowl portion;

a jet water spouting portion for spouting flush water toward the inlet of the drainage passage;

a rim water guide passage for guiding flush water to the rim water spouting portion;

a jet water guide passage for guiding flush water to the jet water spouting portion; and a flow dividing chamber for receiving an inflow of flush water from the discharge port of the reservoir tank, and dividing and distributing the flush water to the rim water guide passage and the jet water guide passage;

wherein the reservoir tank is provided in such a manner that a bottom surface thereof is located spaced apart upwardly from a top surface of the toilet main unit by a predetermined distance, and wherein the flush toilet further comprises a flush-water stagnating portion provided between the discharge port of the reservoir tank and the flow dividing chamber for temporarily stagnating the flush water to apply a hydraulic head pressure to the flush water, wherein the flush water stagnates in the flush-water stagnating portion and the flow dividing chamber, and the stagnated flush water is supplied from the flow dividing chamber to the rim water spouting portion and the jet water spouting portion through the rim water guide passage and the jet water guide passage.

13. A flush toilet having a toilet main unit cleaned by flush water, comprising:

a reservoir tank for storing therein flush water to be supplied to the toilet main unit, the reservoir tank having a discharge port for discharging flush water therethrough;

a bowl portion having a bowl-shaped waste-receiving surface and a rim section located in an upper peripheral region thereof, the rim section having an inward-facing surface;

a drainage passage having an inlet connected to a lower region of the bowl portion to expel waste therethrough by means of siphon action;

a rim water spouting portion provided in the rim section at a position corresponding to a lateral region of the bowl portion, to spout flush water in such a manner as to cause the flush water to swirl in one direction along the inward-facing surface of the rim section so as to clean the bowl portion; and a rim water guide passage for receiving the flush water flown from the discharge port of the reservoir tank and guiding the flush water to the rim water spouting portion;

wherein the discharge port of the reservoir tank is formed at a position offset on one side as viewed from a front side; and the discharge port of the reservoir tank, the rim water guide passage and the rim water spouting portion are formed approximately along a same straight line in plan view; and the toilet main unit is cleaned by 3.6 to 4.2 liters of flush water.

* * * * *